United States Patent [19]

Coffey

[11] Patent Number: 4,606,557

[45] Date of Patent: Aug. 19, 1986

[54] SUBSEA WELLHEAD CONNECTOR

[75] Inventor: William M. Coffey, Houston, Tex.

[73] Assignee: FMC Corporation, Chicago, Ill.

[21] Appl. No.: 491,109

[22] Filed: May 3, 1983

[51] Int. Cl.[4] ..... F16L 37/00

[52] U.S. Cl. ..... 285/18; 285/81; 285/90; 285/309; 285/313; 285/317; 285/404; 292/176; 292/DIG. 24

[58] Field of Search ..... 285/18, 81, 90, 308, 285/309, 313, 317, 403, 404, DIG. 2; 292/DIG. 24, DIG. 61, 176

[56] References Cited

U.S. PATENT DOCUMENTS

| | | | |
|---|---|---|---|
| 557,423 | 3/1896 | Outhouse et al. | 285/317 |
| 1,790,238 | 1/1931 | Klein | 285/317 |
| 3,228,715 | 1/1966 | Neilon et al. | 285/317 |
| 3,645,563 | 2/1972 | Rochelle | 285/317 |
| 3,796,448 | 3/1974 | Ringkamp | 285/404 |
| 3,827,728 | 8/1974 | Hynes | 285/309 |
| 4,312,524 | 1/1982 | Allread | 285/161 |

FOREIGN PATENT DOCUMENTS

| | | | |
|---|---|---|---|
| 381702 | 10/1932 | United Kingdom | 285/317 |
| 413476 | 7/1934 | United Kingdom | 285/317 |
| 415199 | 8/1934 | United Kingdom | 285/317 |
| 1319743 | 6/1973 | United Kingdom | 285/317 |

*Primary Examiner*—Cornelius J. Husar
*Assistant Examiner*—Eric K. Nicholson
*Attorney, Agent, or Firm*—W. W. Ritt, Jr.; Richard B. Megley

[57] ABSTRACT

A pipe connector especially suitable for interconnecting a marine riser to a subsea wellhead, the connector comprising an annular body that telescopes over the wellhead, and a plurality of lockdown screw assemblies extending through radial ports in the body to releasably grip and secure the connector to the wellhead. Each screw assembly comprises a lockdown dog for engaging the recess beneath the wellhead hub flange, a bolt-like dog retainer secured to the dog and slidably extending into a lockdown screw that is threaded into one of the radial ports, and a spring system for biasing the dog away from the lockdown screw towards engagement with the wellhead.

17 Claims, 5 Drawing Figures

FIG_1
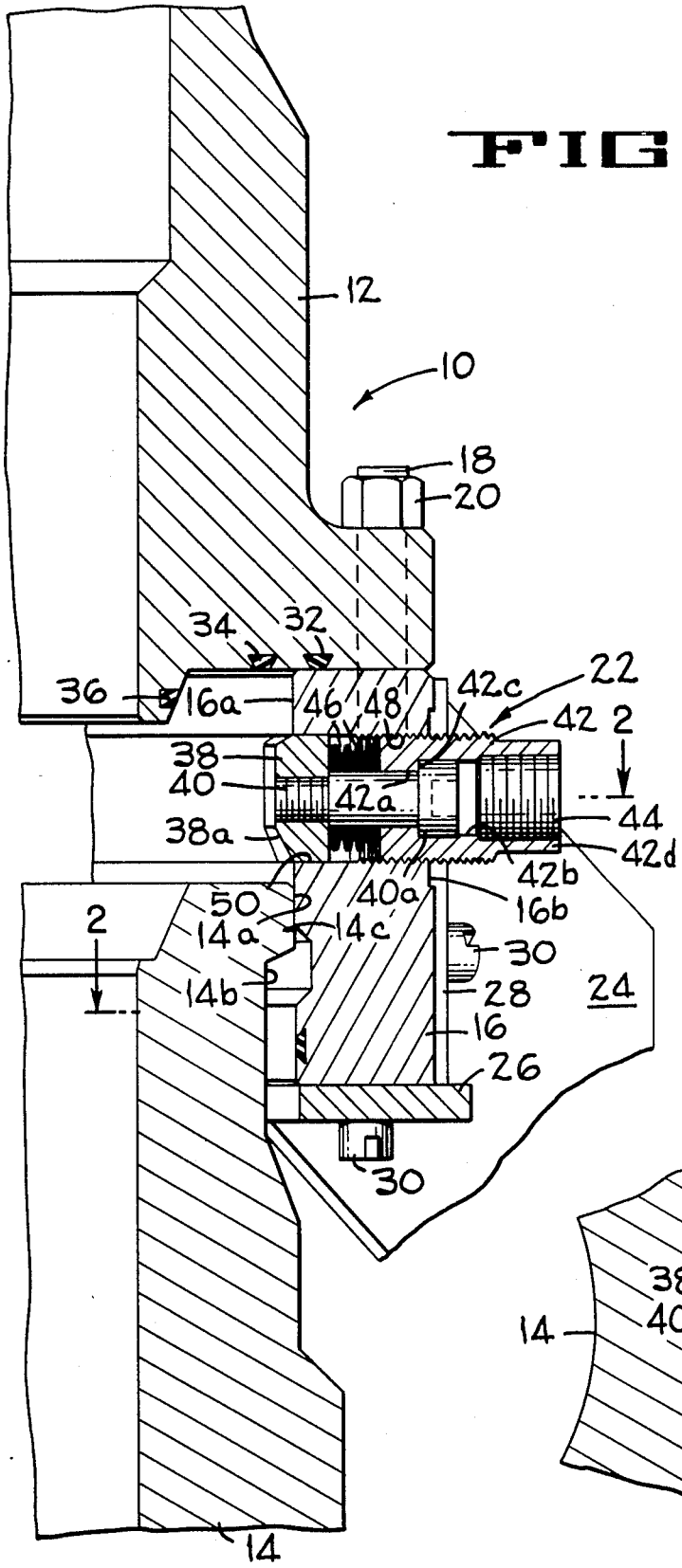
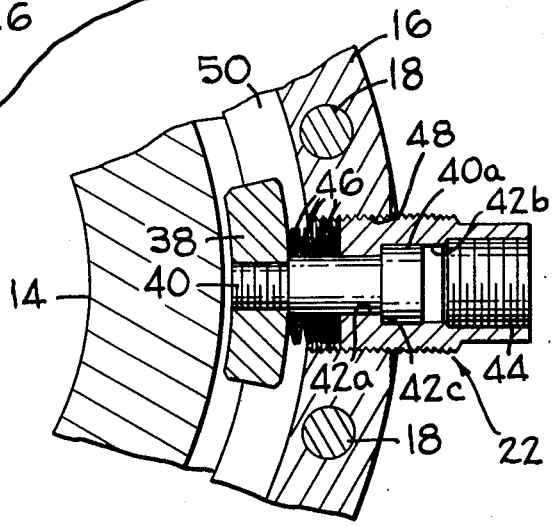
FIG_2

SUBSEA WELLHEAD CONNECTOR

BACKGROUND OF THE INVENTION

This invention pertains to well apparatus, and more particularly to connectors for joining marine risers to subsea wellheads.

When preparing to produce fluids from an offshore well that has been completed with a subsea wellhead, a marine riser pipe is lowered from the surface platform and connected to the wellhead to provide guidance and protection for internally run production casing. In some instances the connection must be accomplished remotely and automatically, i.e., without the assistance of a diver, and the connector also must be capable of being rigidly yet releasably locked to the wellhead with diver assist. Such a connector must have an outside diameter small enough to pass through the platform jacket guides, an ability to adjust for any angular and/or horizontal misalignment with the wellhead, and an inside diameter large enough to pass successive tie-back strings. These requirements seriously restrict the type and design of connector suitable for this purpose, and though many connectors are known none possess all of the required features.

SUMMARY

The present invention includes features that satisfy each of the foregoing requirements. In its preferred embodiment, the present invention comprises an annular connector body that telescopes over the outside of a wellhead and is securable thereto by a plurality of lockdown screw assemblies that automatically engage and securely grip the wellhead as the connector is lowered upon it, that can be locked rigidly in their gripping position by a diver, and that can be unlocked and withdrawn from their gripping position to facilitate removal of the connector from the wellhead. Broadly considered, each of the screw assemblies comprises a lockdown dog, a lockdown screw, a dog retainer element secured to the dog and slidably connected to the screw, an a spring system between the dog and the screw to bias the dog towards its gripping position. The lockdown screw is threaded into a lateral port through the connector body, thereby facilitating position adjustment of the screw to enable the dog to move outwardly against spring pressure sufficiently to pass by the wellhead hub flange as the connector descends onto the wellhead, and then move sufficiently inwardly into the recess below the hub flange in response to spring pressure to grip the wellhead and secure the connector to it. This threaded relationship between the lockdown screw and the wellhead also permits rigidly locking the dog into the recess by rotating the screw to move it inwardly until the spring system has been fully compressed, and then fully withdrawing the dog from the recess, by rotating the screw in the other direction, when release and removal of the connector is desired.

BRIEF DESCRIPTION OF THE DRAWINGS

FIG. 1 is a fragmentary vertical section through a wellhead connector according to the present invention, and through the upper portion of a wellhead onto which the connector has been partially lowered.

FIG. 2 is a view taken along the line 2—2 of FIG. 1.

DESCRIPTION OF THE PREFERRED EMBODIMENT

Figure 3:
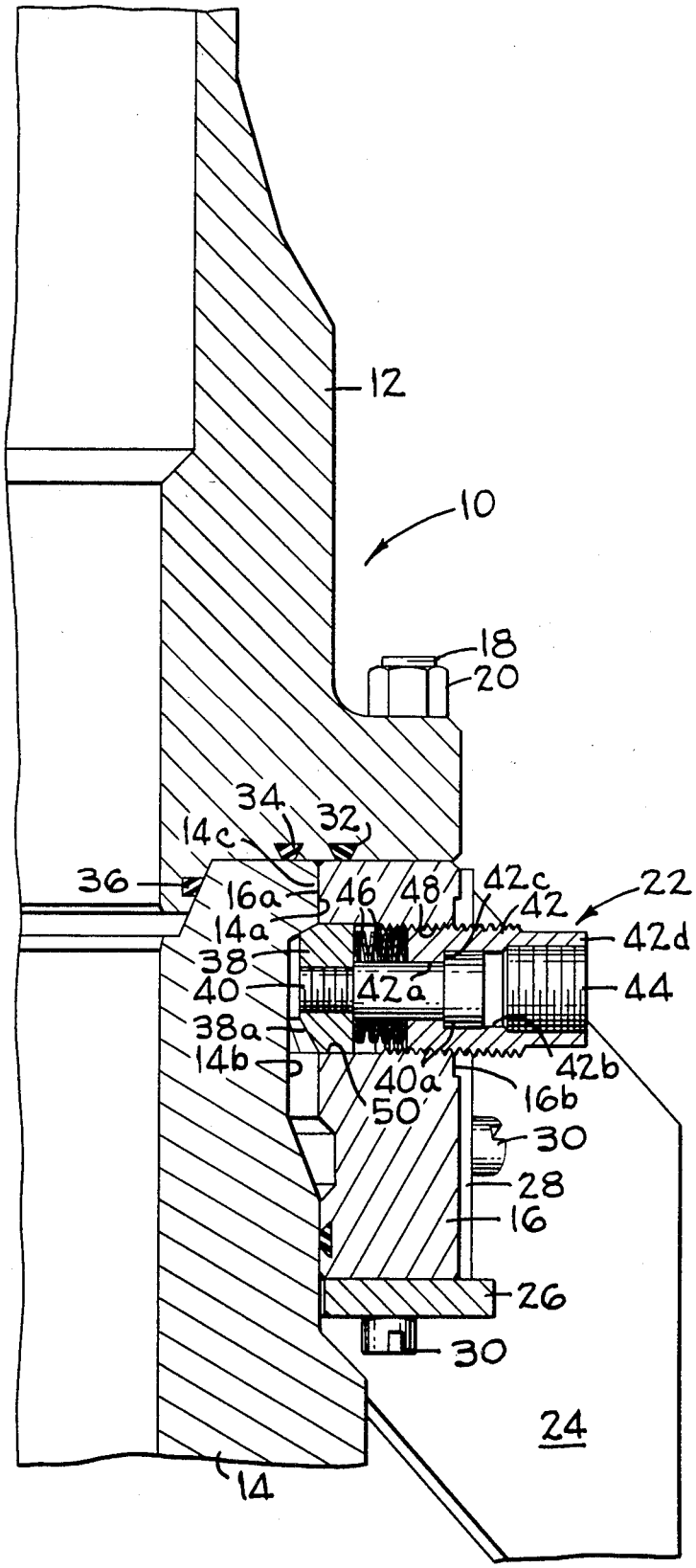
FIG. 3 is a view like FIG. 1 but showing the connector landed on the wellhead and secured thereto by one of its lockdown dogs.

As illustrated in the drawings, the preferred embodiment of a wellhead connector 10 in accordance with the present invention comprises: an upper annular body 12 that, in use, is threaded, bolted, welded or otherwise attached to the lower end of a marine riser or other pipe or well element (not shown) that is to be connected to the upper end or hub of a wellhead 14; an annular lower body 16 that is secured to the lower end of the upper body 12 by, for example, a plurality of circumferentially spaced studs 18 and nuts 20 (only one of each shown); and a plurality (preferably eight) of lockdown screw assemblies 22 (only one shown) circumferentially spaced about and extending radially through the lower body 16. To correct possible misalignment as the connector 10 is being lowered onto the wellhead 14, the connector preferably also includes a guide assembly comprising a plurality of axially-oriented guide fins 24 (only one shown) welded or otherwise fixed to an annular frame including an annular base member 26 and a sleeve-like side member 28, and this guide assembly is secured to the connector lower body 16 by means of a plurality of circumferentially spaced cap screws 30. An O-ring or other suitable annular seal means 32 provides a fluid-tight seal between the upper and lower bodies 12, 16, and when the connector is properly installed on the wellhead 14 (FIGS. 3–5) a pair of O-rings 34, 36 provide a fluid-tight barrier between the upper body and the wellhead.

Each of the lockdown screw assemblies 22 comprises a lockdown dog 38, a dog retainer bolt 40 threaded into the dog 38, a lockdown screw 42 with a central bore **42*a* through which the retainer bolt 40 extends and a counterbore 42*b* in which the retainer bolt head 40*a* resides, a back-up plug 44 threaded into the screw counterbore 42*b*, and a plurality of annular Belleville springs 46 surrounding the shank of the retainer bolt 40 between the dog 38 and the lockdown screw 42. The retainer bolt head 40*a* is of larger diameter than the lockdown screw central bore 42*a*, and thus the annular radial surface 42*c* between the central bore 42*a* and the counterbore 42*b* functions as a stop that prevents axial movement of the bolt 40 towards the center of the connector when the head 40*a* is against that surface 42*c*. Accordingly, in its assembled condition the Belleville springs 46 of the screw assembly 22 are in compression, thereby constantly biasing the dog 38 away from the lockdown screw 42**.

When the lockdown screw assembly 22 is properly installed in the connector 10 (FIG. 1) the lockdown screw 42 extends through a threaded lateral port 48 in the lower body 16, and the lockdown dog 38 slidably resides in an annular groove 50 in the inner surface **16*a* of the lower body. As the connector 10 is lowered from its position shown in FIG. 1 into its landed position shown in FIG. 3 the dog 38, together with the bolt 40, moves radially outward in response to a camming force exerted on the dog's lower inner tapered surface 38*a* as this surface contacts the upper outer edge 14***a* of the wellhead 14. This outward movement of the dog 38 further compresses the Belleville springs 46, and these springs force the dog inwardly into the annular recess 14*b* beneath the wellhead hub flange 14*c* as the connector is landed (FIG. 3). In this landed position the springs 46 exert pressure against the dog 38 sufficient to prevent it from moving outwardly in response to a force tending to lift the connector 10 off the wellhead 14, thereby securing the connector to the wellhead.

Figure 4:
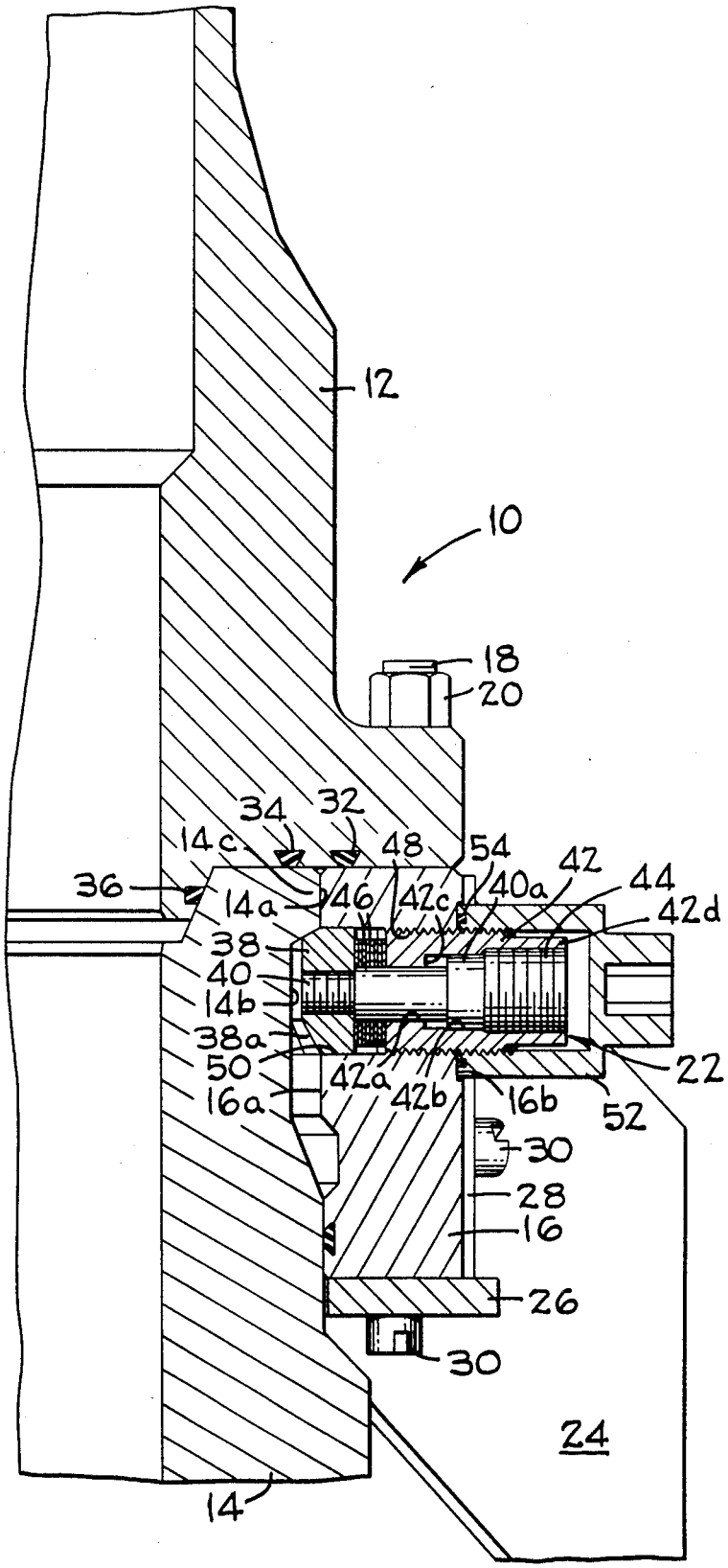
FIG. 4 is a view like FIG. 3 but showing the lockdown dog rigidly locked in its functional position.

The outer end portion 42*d* of the lockdown screw 42 is hexagonal or otherwise shaped to accept a wrench, whereby the screw 42 can be threaded inwardly into the position shown in FIG. 4, thereby fully compressing the springs 46 and rigidly locking the dog 38 in its wellhead gripping position.

In order to protect the exposed portion of the screw assembly 22 from damage or contamination, a cap 52 can be threaded onto the screw 42 until an O-ring 54 in the cap's forward end face establishes a seal with the outer surface 16*b* of the lower body 16.

Figure 5:
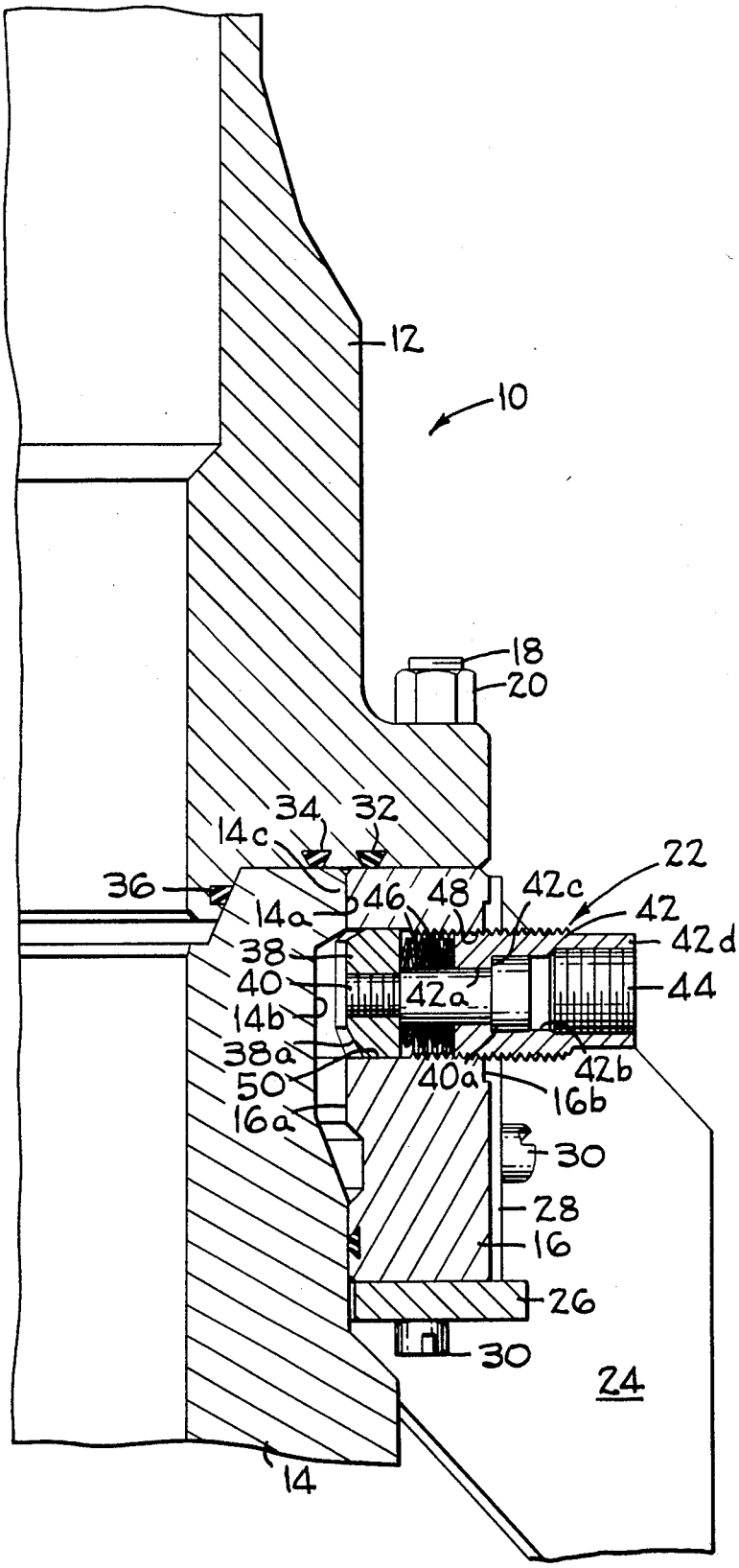
FIG. 5 is a view like FIG. 3 but showing the lockdown dog retracted for removing the connector from the wellhead.

When removal of the connector 10 from the wellhead 14 is desired, the protective cap 52 is removed from the lockdown screw 42 and the screw 42 then backed out of the connector port 48 into the position shown in FIG. 5, thereby withdrawing the lockdown dog 38 from the wellhead recess 14*b* and pulling it fully into the connector groove 50. With the dog 38 in this position, the connector 10 can then be lifted free of the wellhead 14 for retrieval at the surface platform.

What is claimed is:

1. A pipe connector especially suitable for connecting a marine riser to a subsea wellhead, said connector comprising:

(a) an annular connector body;

(b) means for attaching the connector body to a marine riser; and (c) a plurality of lockdown screw assemblies extending through radial ports in the connector body, each of said screw assemblies comprising:

(1) a lockdown dog;

(2) a lockdown screw movably secured to its respective port in the connector body, said lockdown screw having a central bore and a counterbore communicating therewith;

(3) a dog retainer secured to the lockdown dog and slidably extending through the central bore of the lockdown screw, said dog retainer being bolt-shaped with a shank and a head, said shank extending through said bore and said head residing in said counterbore; and (4) a spring system between the lockdown dog and the lockdown screw to bias the dog from the screw.

2. A pipe connector according to claim 1 including a backup plug threaded into said counterbore.

3. A pipe connector according to claim 1 wherein the dog retainer is threaded to the lockdown dog.

4. A pipe connector according to claim 1 wherein the lockdown dog includes a tapered surface to cooperate with an edge of a wellhead to establish a camming force tending to move the dog towards the lockdown screw.

5. A pipe connector according to claim 1 wherein the connector body has an inner annular groove, intersected by the radial ports, and wherein the lockdown dog resides slidably in said groove.

6. A pipe connector according to claim 1 wherein the spring system comprises a plurality of Belleville springs.

7. A pipe connector according to claim 1 wherein the connector body comprises an upper body member, a lower body member releasably secured to said upper body member, and means for establishing a pressure seal between said upper and lower body members.

8. A pipe connector according to claim 4 wherein the radial ports extend through the lower body element.

9. A pipe connector according to claim 1 including guide means connected to the connector body for correcting misalignment of said connector with respect to a wellhead onto which it is being lowered.

10. A pipe connector according to claim 1 including a protective cap for the lockdown screw, said cap and screw having cooperative means to removably install said cap over an end portion of said screw.

11. A pipe connector according to claim 1 wherein the lockdown screw includes means for cooperating with a wrench to rotate said screw with respect to the connector body.

12. A pipe connector according to claim 1 including means for establishing a pressure seal between the connector and a wellhead.

13. A lockdown screw assembly for use in a marine riser connector to releasably secure said connector to a subsea wellhead, said screw assembly comprising:

(a) a lockdown dog;

(b) a lockdown screw having a central bore and a counterbore communicating therewith;

(c) a dog retainer secured to the lockdown dog and slidably extending through the central bore of the lockdown screw, said dog retainer being bolt-shaped with a shank and a head, said head residing in said counterbore and said shank extending through said bore; and (d) a spring system between the dog and the screw for biasing the dog away from the screw.

14. A lockdown screw assembly according to claim 18 including a backup plug threaded into said counterbore.

15. A lockdown screw assembly according to claim 13 wherein the lockdown dog and the dog retainer are threadedly interconnected.

16. A lockdown screw assembly according to claim 13 wherein the spring system comprises a plurality of Belleville springs.

17. A lockdown screw assembly according to claim 13 including a protective cap with means for releasably securing said cap to one end of the lockdown screw.

* * * * *